US009627810B2

(12) United States Patent
Sakamoto et al.

(10) Patent No.: US 9,627,810 B2
(45) Date of Patent: Apr. 18, 2017

(54) LEVER-TYPE CONNECTOR

(71) Applicant: YAZAKI CORPORATION, Tokyo (JP)

(72) Inventors: Nobuyuki Sakamoto, Shizuoka (JP); Toshinori Yamamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/913,777

(22) PCT Filed: Sep. 17, 2014

(86) PCT No.: PCT/JP2014/074556

§ 371 (c)(1),
(2) Date: Feb. 23, 2016

(87) PCT Pub. No.: WO2015/041248

PCT Pub. Date: Mar. 26, 2015

(65) Prior Publication Data

US 2016/0226187 A1 Aug. 4, 2016

(30) Foreign Application Priority Data

Sep. 17, 2013 (JP) ..... 2013-192168

(51) Int. Cl.
*H01R 13/62* (2006.01)
*H01R 13/629* (2006.01)
*H01R 13/64* (2006.01)

(52) U.S. Cl.
CPC ..... *H01R 13/62955* (2013.01); *H01R 13/64* (2013.01)

(58) Field of Classification Search
CPC ..... H01R 13/62938; H01R 13/62955; H01R 12/7005
See application file for complete search history.

(56) References Cited

U.S. PATENT DOCUMENTS 5,330,411 A 7/1994 Fujitani et al.
7,384,286 B2 * 6/2008 Imai ..... H01R 13/62938 439/157

(Continued)

FOREIGN PATENT DOCUMENTS

JP 5-36775 U 5/1993
JP 2003-249304 A 9/2003
JP 2003-264036 A 9/2003

OTHER PUBLICATIONS

International Search Report and Written Opinion of the International Search Report for PCT/JP2014/074556 dated Dec. 16, 2014.

(Continued)

*Primary Examiner* — Xuong Chung Trans
(74) *Attorney, Agent, or Firm* — Kenealy Vaidya LLP

(57) ABSTRACT

In a lever-type connector (1) including a temporary lever lock mechanism (40) that temporarily locks in an initial rotation position a fitting operation lever (30) rotatably provided in a lever accommodation space (15) defined in an inner side of one outer side wall of a first connector housing (10) and a temporary lock release mechanism (50) that releases the temporary locked state of the fitting operation lever (30) when the first connector housing (10) is butted on a second connector housing (20) in a fitting start position, the fitting operation lever (30) is provided with a mark (38*a*) that is exposed outside the first connector housing (10) when the temporary locked state is released.

5 Claims, 12 Drawing Sheets

(56) References Cited

U.S. PATENT DOCUMENTS

| | | | | |
|---|---|---|---|---|
| 7,445,474 | B2 * | 11/2008 | Sakatani ..... | H01R 13/62938<br>439/157 |
| 7,559,780 | B2 * | 7/2009 | Mizoguchi ..... | H01R 13/62955<br>439/157 |
| 8,641,433 | B2 * | 2/2014 | Uchida ..... | H01R 13/62955<br>439/157 |
| 2003/0162427 | A1 | 8/2003 | Shinozaki et al. | |

OTHER PUBLICATIONS

International Preliminary Report on Patentability and English language Written Opinion of the International Search Report for PCT/JP2014/074556.

* cited by examiner

LEVER-TYPE CONNECTOR

TECHNICAL FIELD

The present invention relates to a lever-type connector.

BACKGROUND ART

FIG. 12 and FIG. 13 show a lever-type connector disclosed in below-described patent literature 1. The lever-type connector 100 includes a first connector housing 110, a second connector housing 120, a fitting operation lever 130, a temporary lever lock mechanism 140 and a temporary lock release mechanism 150.

The first connector housing 110 has a lever accommodation space 111 defined in an inner side of one outer side wall not shown in the drawing which passes through in a mutual fitting direction (a direction shown by an arrow mark X1 in FIG. 12) of both the connector housing.

The second connector housing 120 includes a fitting part 121 which fits the first connector housing 110 inside and a fitting protrusion 123 which is protruded on an inner side surface (not shown in the drawing) of the fitting part 121 opposed to the one outer side wall of the first connector housing 110 which is not shown in the drawing.

The fitting operation lever 130 includes a lever main body 131 supported in the lever accommodation space 111 so as to be rotatable on a pivot 113 as a supporting point of rotation and an operation part 132 extended to one end of the lever main body 131.

As shown in FIG. 12, the fitting operation lever 130 is provided so as to be rotatable on the pivot 113 as a center of rotation within a range of an angle θ from an initial rotation position P1 to a rotation finish position P2. The operation part 132 is a part to be gripped when the fitting operation lever 130 is operated to rotate and provided under a state that the fitting operation lever 130 is extended to an external part from the lever accommodation space 111. An arrow mark R1 drawn in FIG. 12 shows a rotating direction when the fitting operation lever 130 is rotated from the initial rotation position P1 to the rotation finish position P2.

In the lever main body 131 of the fitting operation lever 130, there are provided a cam groove 134 in which the fitting protrusion 123 of the second connector housing 120 can slide and an elastic engagement piece 135 which allows the fitting operation lever 130 to be temporarily locked in the initial rotation position P1.

The cam groove 134 is formed in such a way that when the first connector housing 110 is butted on the second connector housing 120 in a fitting start position under a state that the fitting operation lever 130 is located in the initial rotation position P1 as shown in FIG. 13, the fitting protrusion 123 on the second connector housing 120 enters a start end 134*a* of the groove. Further, when the fitting operation lever 130 is operated to rotate from the initial rotation position P1 to a side of the rotation finish position P2, the fitting protrusion 123 engaged with the start end 134*a* of the groove is drawn in a fitting direction. And when the fitting operation lever 130 reaches the rotation finish position P2, the first connector housing 110 is completely fitted to the second connector housing 120.

The elastic engagement piece 135 has a structure that an engaging protrusion 135*b* is provided in a tip end of an elastic piece 135*a* extended along an outer periphery of the lever main body 131. The protrusion 135*b* can be displaced to a side of the center of rotation by a flexible deformation of the elastic piece 135*a*. The protrusion 135*b* at the tip end is engaged with the temporary lever lock mechanism 140 provided in the lever accommodation space 111 of the first connector housing 110, so that the elastic engagement piece 135 positions the fitting operation lever 130 in the initial rotation position P1.

As shown in FIG. 12, in the temporary lever lock mechanism 140, when a stepped part provided in the lever accommodation space 111 is engaged with the elastic engagement piece 135 of the above-described fitting operation lever 130, the temporary lever lock mechanism 140 temporarily locks the fitting operation lever 130 in the initial rotation position P1.

The temporary lock release mechanism 150 is a rib which is allowed to stand upright in the inner side surface of the fitting part 121 in the second connector housing 120 so as to be opposed to the temporary lever lock mechanism 140 provided in the lever accommodation space 111. As shown in FIG. 13, when the first connector housing 110 is butted on the second connector housing 120 in the fitting start position, the temporary lock release mechanism 150 moves forward to the temporary lever lock mechanism 140. Thus, the elastic engagement piece 135 is flexibly deformed so as to be disengaged from the temporary lever lock mechanism 140, so that the temporary locked state by the temporary lever lock mechanism 140 is released.

CITATION LIST

Patent Literature

Patent Literature 1: JP-A-2003-249304

SUMMARY OF INVENTION

Technical Problem

However, in the case of the lever-type connector 100 disclosed in the above-described patent literature 1, since the temporary lever lock mechanism 140 which allows the fitting operation lever 130 to be temporarily locked in the initial rotation position P1 is accommodated in the lever accommodation space 111, the temporary lever lock mechanism 140 cannot be visually recognized from an external part.

Further, when the first connector housing 110 is butted on the second connector housing 120 in the fitting start position as shown in FIG. 13, even if the temporary lock release mechanism 150 provided in the second connector housing 120 releases the temporary locked state by the temporary lever lock mechanism 140, a distinguished change does not appear in an external appearance.

Accordingly, the first connector housing 110 is butted on the second connector housing 120 in the fitting start position, and in this case, even when the temporary lock release mechanism 150 cannot release the temporary locked state due to, for instance, insufficient butting, this state cannot be discriminated from the external appearance. As a result, there is a fear that a rotation operating force is unnaturally applied to the fitting operation lever 130 whose temporary locked state is not released to break the elastic engagement piece 135 or the temporary lever lock mechanism 140.

Thus, it is an object of the present invention to solve the above-described problem and to provide a lever-type connector which can simply discriminate whether or not a temporary locked state of a fitting operation lever is released and can prevent the fitting operation lever whose temporary locked state is not released from being forcedly rotated.

Solution to Problem

The above-described object of the present invention is achieved by below-described structures.

(1) A lever-type connector including:

a first connector housing that has a lever accommodation space being defined in an inner side of one outer side wall and passing through in a mutual fitting direction of connector housings, a second connector housing that has a fitting part fitted to an inner side of the first connector housing and a fitting protrusion protruding on an outer side surface of the fitting part opposed to the one outer side wall, a fitting operation lever provided in the lever accommodation space so as to be rotatable from an initial rotation position to a rotation finish position, a temporary lever lock mechanism that is provided in the lever accommodation space to temporarily lock the fitting operation lever in the initial rotation position, and a temporary lock release mechanism that is provided in the second connector housing to release the temporary locked state by the temporary lever lock mechanism when the first connector housing is butted on the second connector housing in a fitting start position, wherein the fitting operation lever is provided with a cam groove that allows the fitting protrusion to enter a start end of the cam groove when the first connector housing is butted on the second connector housing in the fitting start position under a state that the fitting operation lever is located in the initial rotation position, allows the fitting protrusion to be drawn in a fitting direction when the fitting operation lever is operated to rotate from the initial rotation position to a side of the rotation finish position, and allows the first connector housing and the second connector housing to be completely fitted to each other when the fitting operation lever reaches the rotation finish position, and the fitting operation lever is provided with a mark that is covered in an inner side of one side edge of the one outer side wall when the fitting operation lever is located in the temporary locked state by the temporary lever lock mechanism, and is exposed outside the one side edge of the one outer side wall by a minute rotation of the fitting operation lever due to an urging force of the temporary lock release mechanism to release the temporary locked state when the temporary locked state is released by the temporary lock release mechanism.

(2) The lever-type connector according to the above-described (1), wherein the mark is one linear side forming an edge of a recessed part formed on a surface of the fitting operation lever.

According to the structure of the above-described (1), when the fitting operation lever is temporarily locked in the initial rotation position by the temporary lever lock mechanism of the first connector housing, the mark provided on the fitting operation lever is hidden in the inner side of the one outer side wall of the first connector housing, so that the mark cannot be visually recognized from an external part. However, when the first connector housing is butted on the second connector housing in the fitting start position and the temporary locked state of the fitting operation lever is released by the temporary lock release mechanism of the second connector housing, the mark on the fitting operation lever is exposed outside the one side edge of the one outer side wall of the first connector housing by the minute rotation of the fitting operation lever due to the urging force when the temporary lock release mechanism releases the temporary locked state. Accordingly, by visually recognizing whether or not the mark is exposed outside the first connector housing, whether or not the temporary locked state of the fitting operation lever is released can be simply discriminated.

Accordingly, an operational error that the fitting operation lever whose temporary locked state is not released is forcedly rotated can be avoided and the fitting operation lever or the temporary lever lock mechanism can be prevented from being broken by the operational error.

According to the structure of the above-described (2), the mark of the fitting operation lever is the one linear side forming the edge of the recessed part formed on the surface of the fitting operation lever. Accordingly, when the fitting operation lever is formed by, for instance, an injection molding of a resin, the recessed part is formed in a prescribed position so that the mark may be simply applied thereto. Thus, the mark can be easily provided.

Advantageous Effects of Invention

According to the lever-type connector of the present invention, whether or not the temporary locked state of the fitting operation lever is released can be simply discriminated and the fitting operation lever whose temporary locked state is not released can be prevented from being forcedly rotated.

As described above, the present invention is briefly explained. Further, when a mode for carrying out the invention which is described below (refer it to as an "embodiment", hereinafter) is read by referring to the attached drawings, a detail of the present invention will be more clarified.

DESCRIPTION OF EMBODIMENTS

Figure 1:
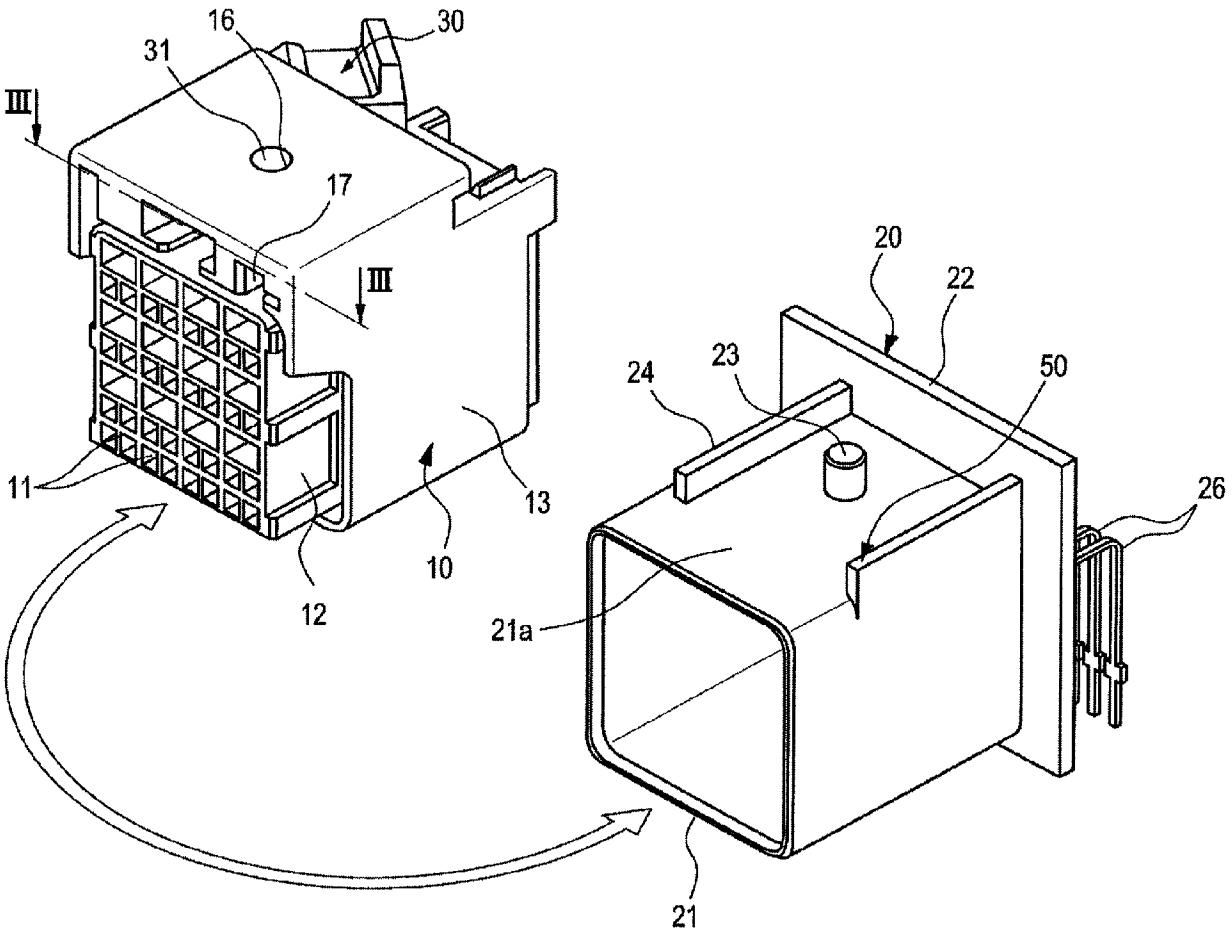
FIG. 1 is an exploded perspective view of an embodiment of a lever-type connector according to the present invention.

Now, a preferred embodiment of a lever-type connector according to the present invention will be described below in detail by referring to the drawings.

Figure 2:
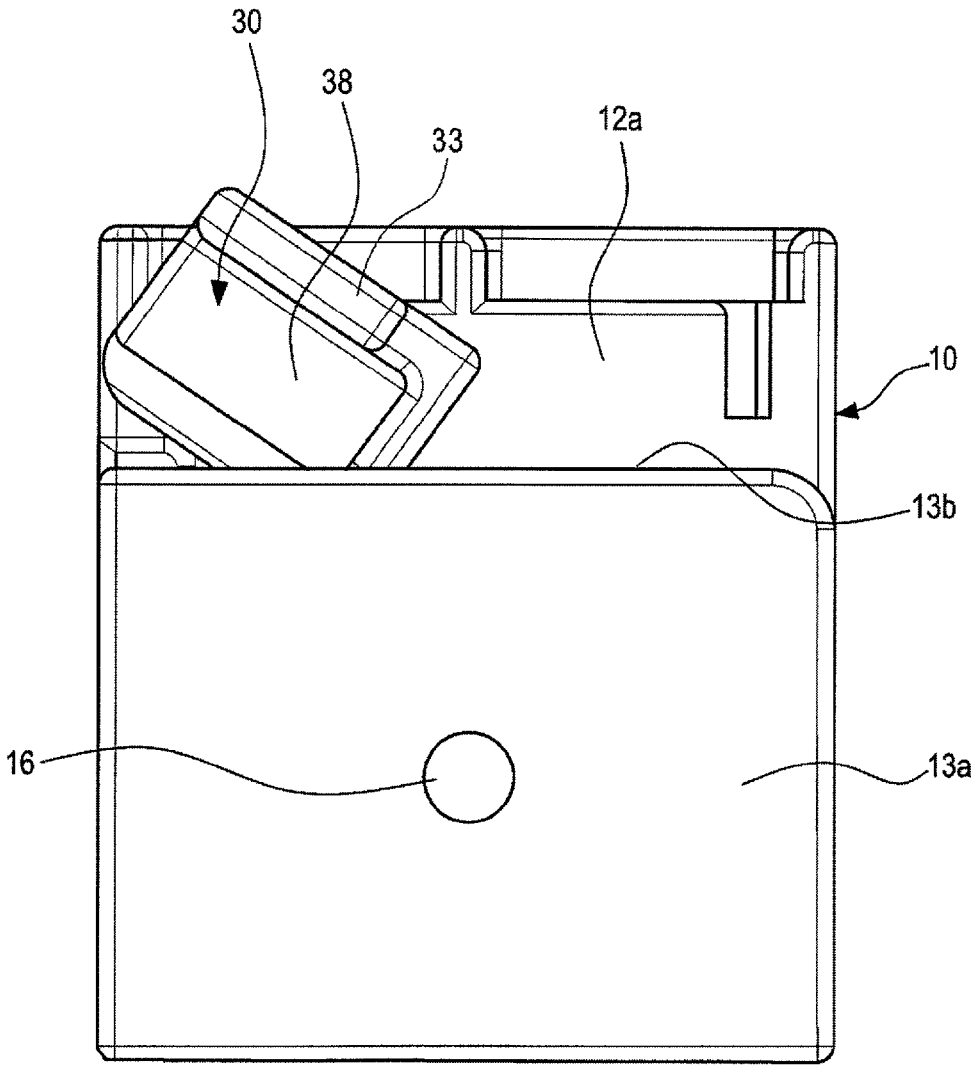
FIG. 2 is a plan view of a first connector housing shown in FIG. 1.
Figure 3:
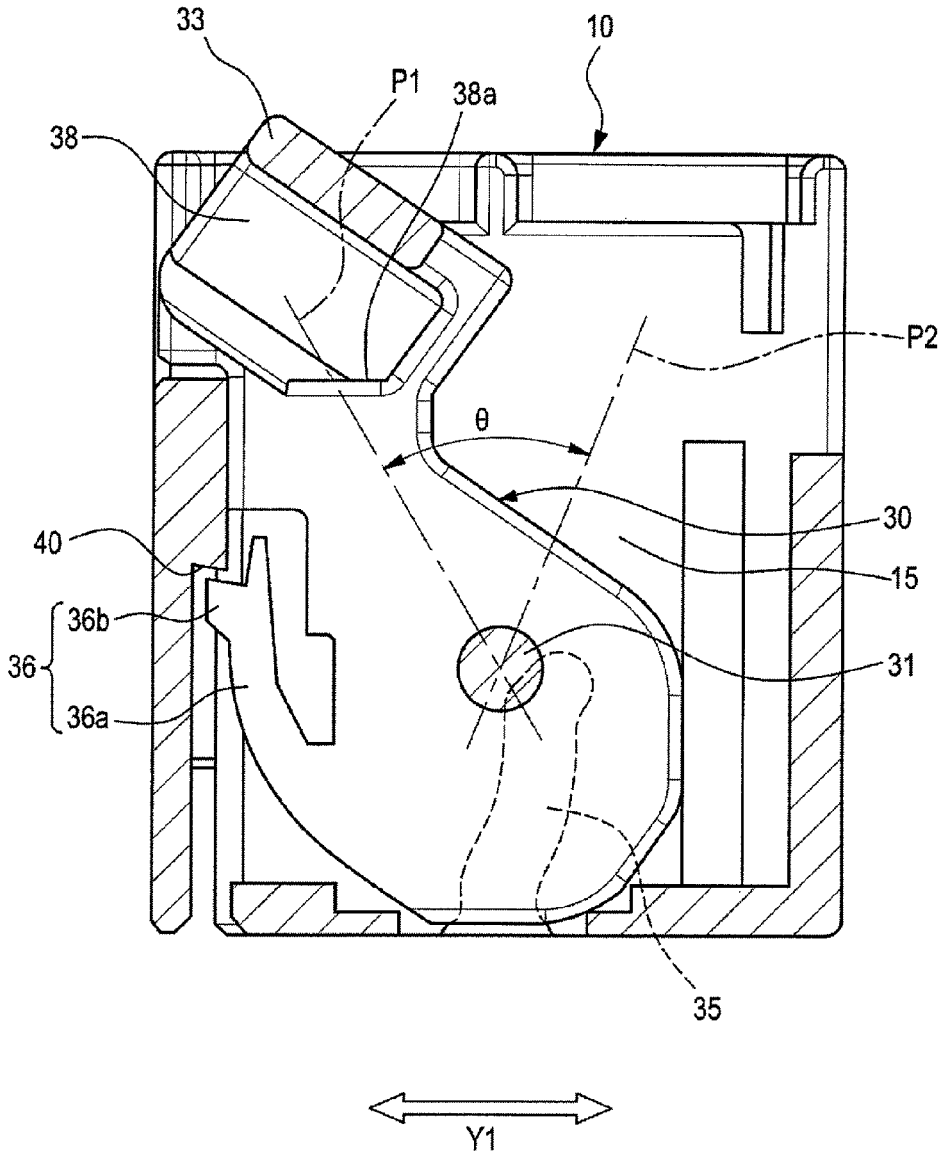
FIG. 3 is a sectional view taken along a line III-III in the first connector housing shown in FIG. 1.
Figure 4:
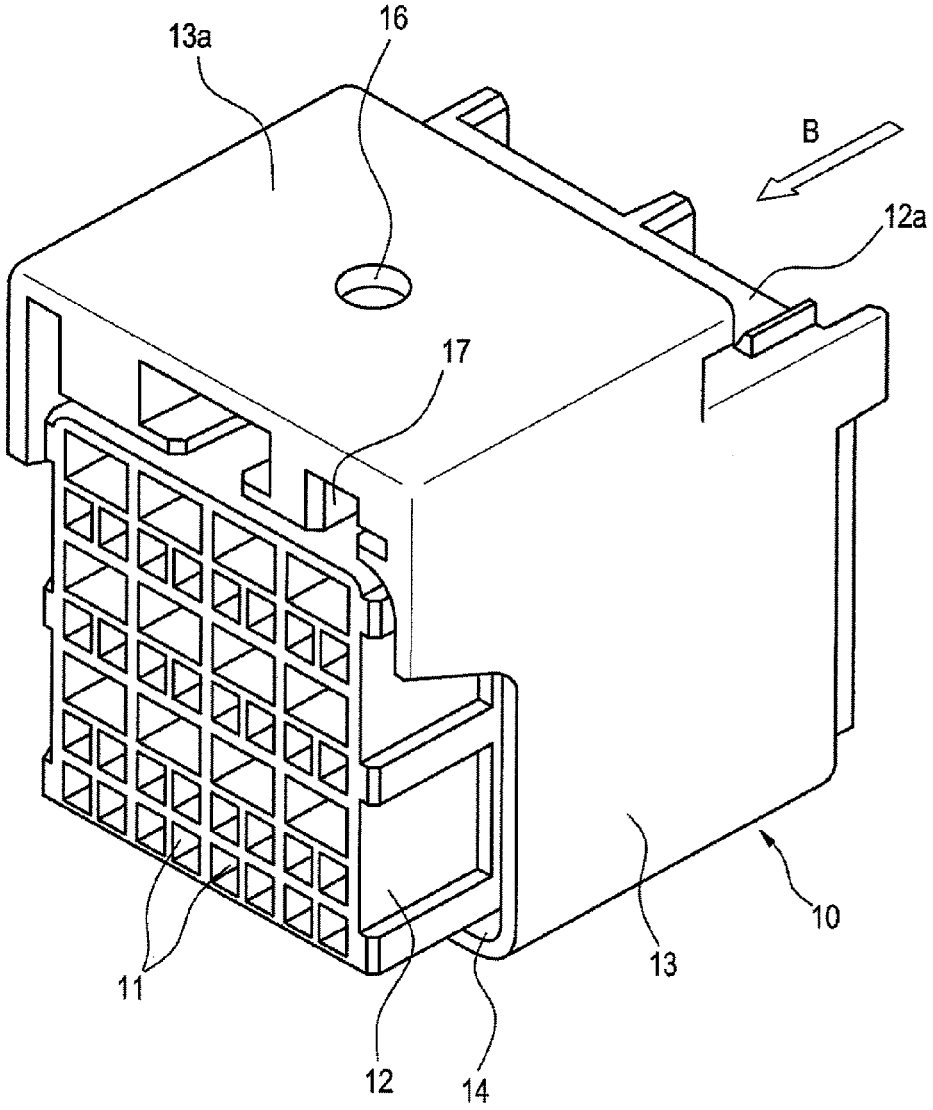
FIG. 4 is a perspective view of a single body of the first connector housing shown in FIG. 1.
Figure 5:
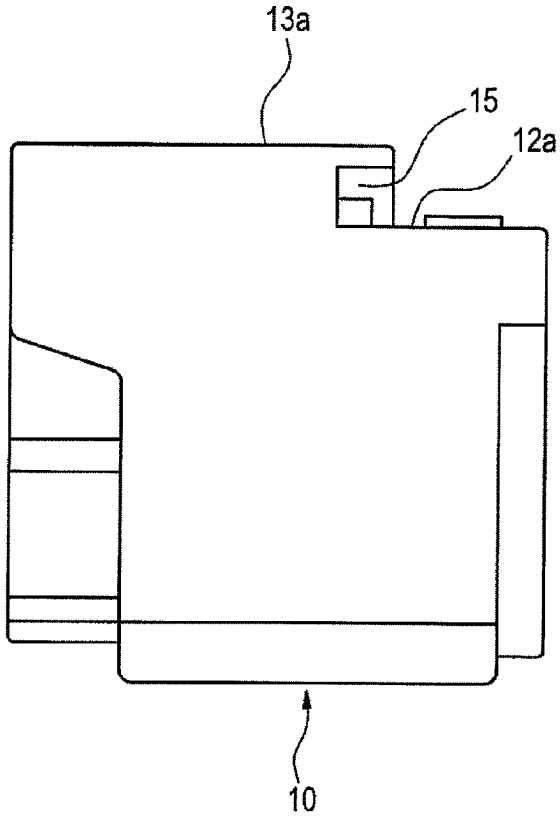
FIG. 5 is a side view of the first connector housing shown in FIG. 4.
Figure 6:
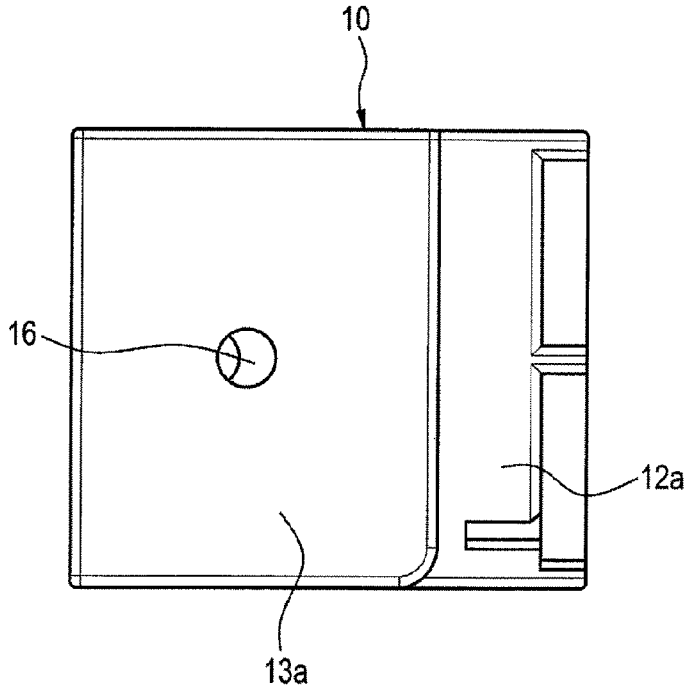
FIG. 6 is a plan view of the first connector housing shown in FIG. 4.
Figure 7:
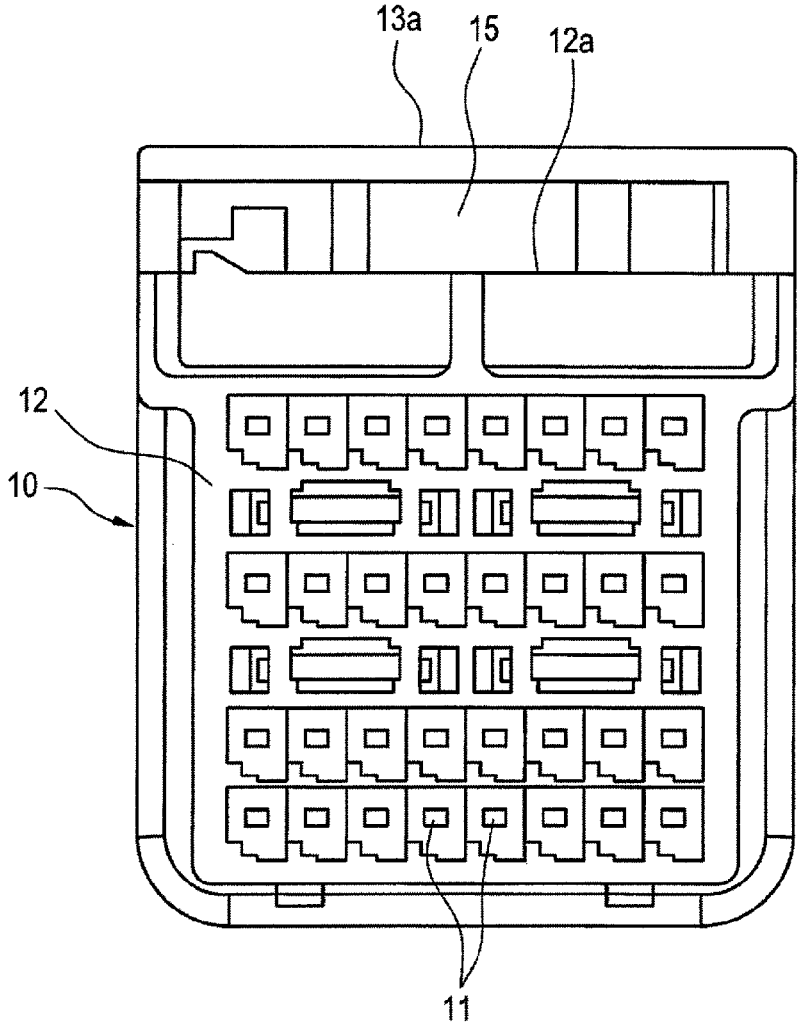
FIG. 7 is a diagram of the first connector housing shown in FIG. 4 which is viewed from a direction shown by an arrow mark B.

A lever-type connector 1 of an embodiment of the present invention includes, as shown in FIG. 1 to FIG. 3, a first connector housing 10, a second connector housing 20, a fitting operation lever 30, a temporary lever lock mechanism 40 and a temporary lock release mechanism 50.

As shown in FIG. 4 to FIG. 7, the first connector housing 10 includes a substantially rectangular post shaped terminal accommodation part 12 which has a plurality of terminal accommodation holes 11 and an outer tube part 13 formed in a tubular configuration which surrounds an outer periphery of the terminal accommodation part 12. The outer tube part 13 has a clearance 14 defined in a periphery of the terminal accommodation part 12. To the clearance 14, a rectangular tube shaped fitting part (a hood part) 21 of the second connector housing 20 is fitted.

Further, an upper wall 13*a* of the outer tube part 13 is an outer side wall of an upper side of the first connector housing 10. The upper wall 13*a* as the one outer side wall of the first connector housing 10 defines a lever accommodation space 15 between an upper wall 12*a* of the terminal accommodation part 12 located in an inner side of the outer tube part 13 and the upper wall 13*a*. The lever accommodation space 15 is a space where the fitting operation lever 30 is accommodated and formed to pass through in a mutual fitting direction (a direction shown by an arrow mark X2 in FIG. 11) of the connector housings.

Namely, the first connector housing 10 of the present embodiment has the lever accommodation space 15 defined in the inner side of the upper wall 13*a* as the one outer side wall thereof. The lever accommodation space 15 passes through the first connector housing 10 in the mutual fitting direction of the connector housings.

In the upper wall 13*a* of the present embodiment, a lever support hole 16 is formed which rotatably supports the fitting operation lever 30. Further, the upper wall 13*a* is formed so as to be shorter than the upper wall 12*a* of the terminal accommodation part 12 in the fitting direction so that a below-described operation part 33 of the fitting operation lever 30 is exposed in a rear part of the upper wall 13*a*.

In the lever accommodation space 15 of the first connector housing 10, the above-described temporary lever lock mechanism 40 is provided. The temporary lever lock mechanism 40 of the present embodiment is formed in such a way, as shown in FIG. 3, that an abutting surface extending in a direction of width of the housing (a direction shown by an arrow mark Y1 in FIG. 3) is engaged with a below-described elastic engagement piece 36 of the fitting operation lever 30 to temporarily lock the fitting operation lever 30 in an initial rotation position P1.

As shown in FIG. 1, the second connector housing 20 includes the rectangular tube shaped fitting part 21 fitted to the inner side of the outer tube part 13 of the first connector housing 10, a terminal support part 22 located in a rear end of the fitting part 21, a fitting protrusion 23 protruding on an upper wall surface 21*a* of the fitting part 21, a guide wall 24, and the above-described temporary lock release mechanism 50.

The terminal support part 22 supports a plurality of terminal fittings 26 fitted to terminal fittings (not shown in the drawing) accommodated in the terminal accommodation part 12 of the first connector housing 10.

The upper wall surface 21*a* of the fitting part 21 is an outer side surface opposed to the upper wall 13*a* of the first connector housing 10. The fitting protrusion 23 protruding on the upper wall surface 21*a* is a cylindrical cam follower which is engaged with a below-described cam groove 35 of the fitting operation lever 30 so as to freely slide.

The guide wall 24 is protruded on the upper wall surface 21*a*. The guide wall 24 is extended along the mutual fitting direction of the connector housings. The guide wall 24 is fitted to a guide groove 17 formed in the first connector housing 10 when the first connector housing 10 is fitted to the second connector housing 20 to prevent the second connector housing 20 from being inclined relative to the fitting direction.

Figure 11:
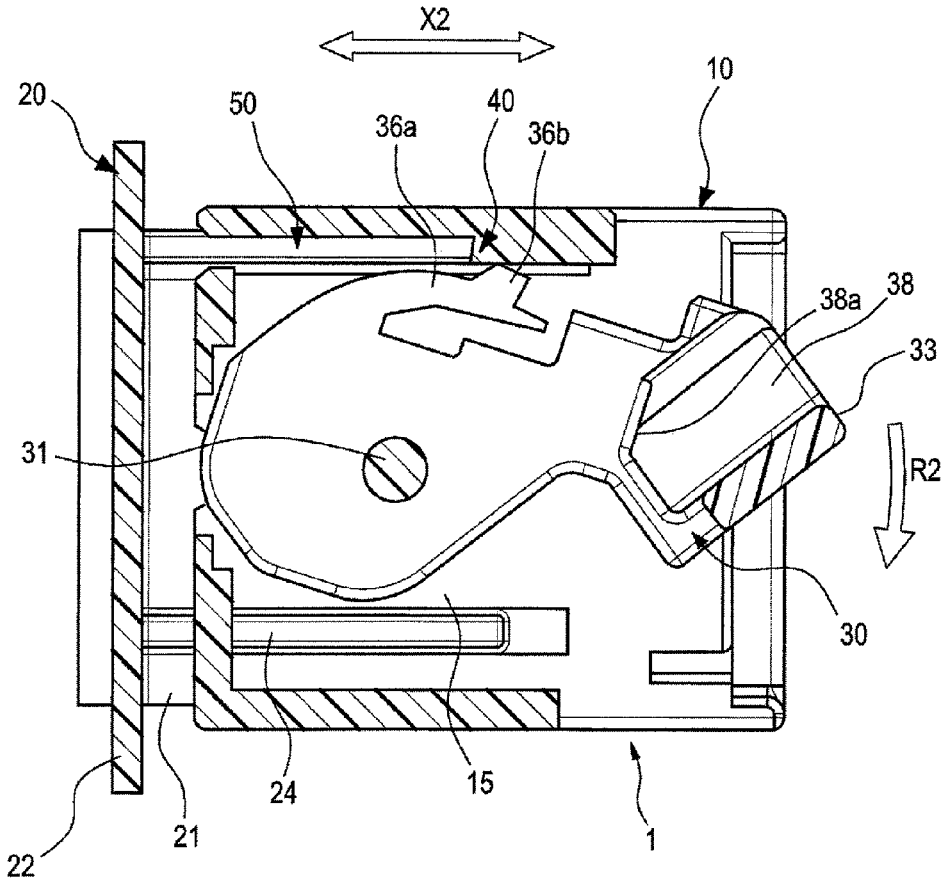
FIG. 11 is an explanatory view of a state that the first connector housing and the second connector housing are butted on each other in the fitting start position, so that a temporary lock release mechanism of the second connector housing releases a temporary locked state of the fitting operation lever.
Figure 12:
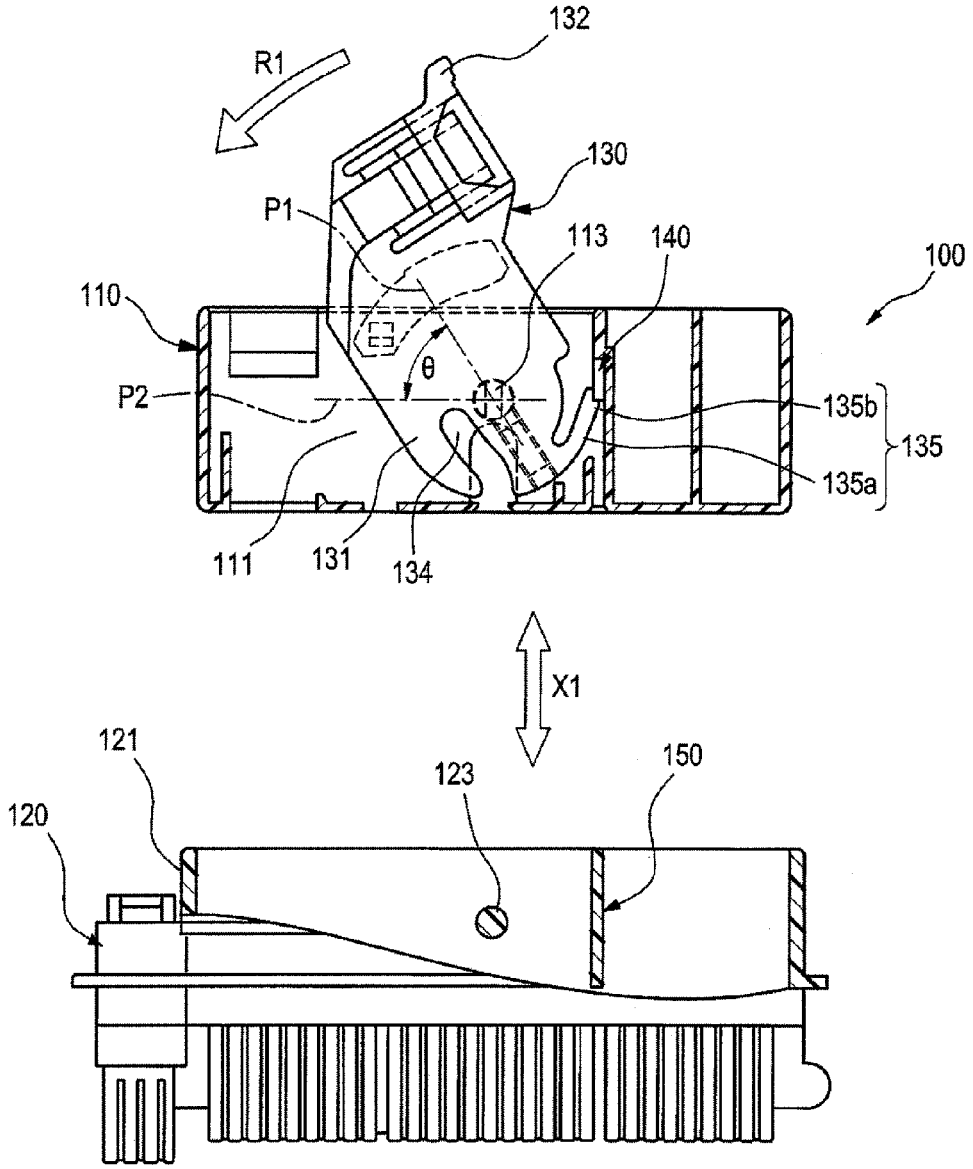
FIG. 12 is a plan view of a state that a first connector housing and a second connector housing of a usual lever-type connector are opposed to each other.
Figure 13:
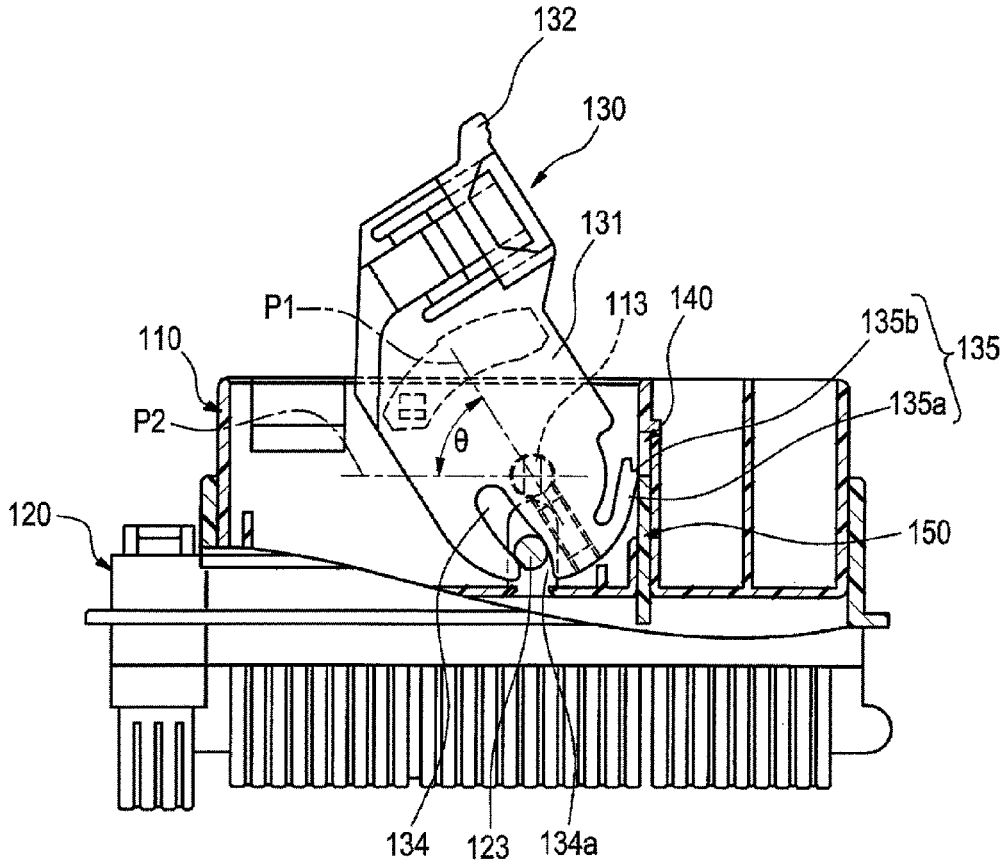
FIG. 13 is a sectional view showing a state that the first connector housing and the second connector housing shown in FIG. 12 are butted on each other in a fitting start position, so that a temporary locked state of a fitting operation lever is released.

The temporary lock release mechanism 50 provided in the second connector housing 20 is, as shown in FIG. 11, a rib which is allowed to stand upright on the upper wall surface 21*a* of the second connector housing 20 so as to be opposed to the abutting surface as the temporary lever lock mechanism 40 in the lever accommodation space 15. As shown in FIG. 11, when the first connector housing 10 is butted on the second connector housing 20 in a fitting start position, the temporary lock release mechanism 50 moves forward to the temporary lever lock mechanism 40 to flexibly deform the elastic engagement piece 36 so as to disengage the elastic engagement piece 36 from the temporary lever lock mechanism 40, and release the temporary locked state by the temporary lever lock mechanism 40. At this time, the fitting operation lever 30 is minutely rotated in a direction shown by an arrow mark R2 by an urging force of the temporary lock release mechanism 50 to flexibly deform the elastic engagement piece 36 and release the temporary locked state.

Figure 8:
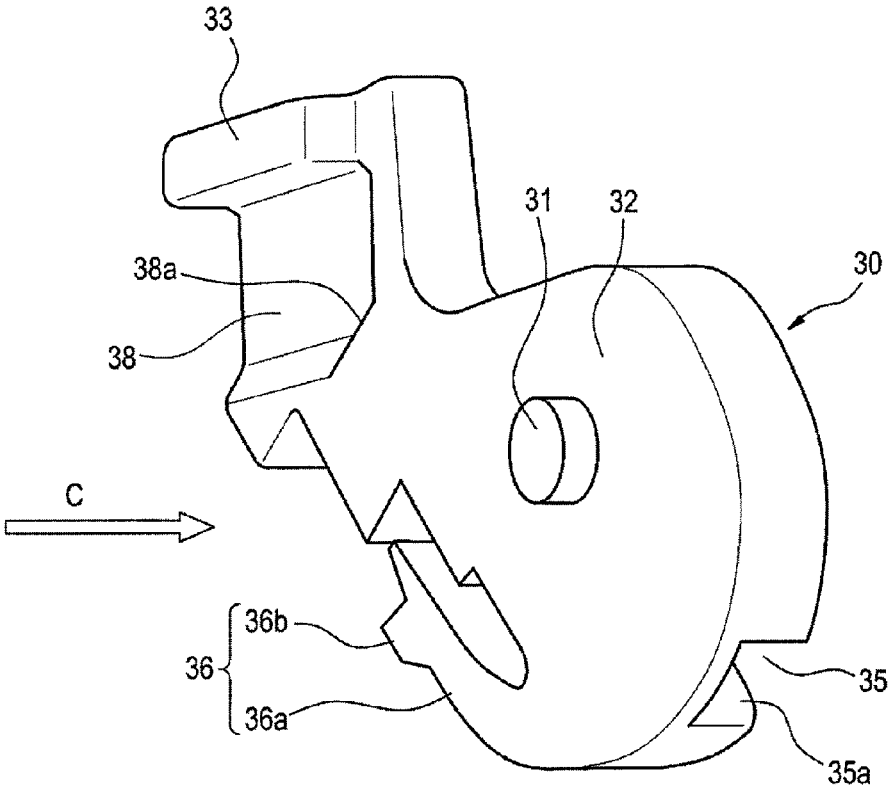
FIG. 8 is a perspective view of a single article of a fitting operation lever shown in FIG. 1.
Figure 9:
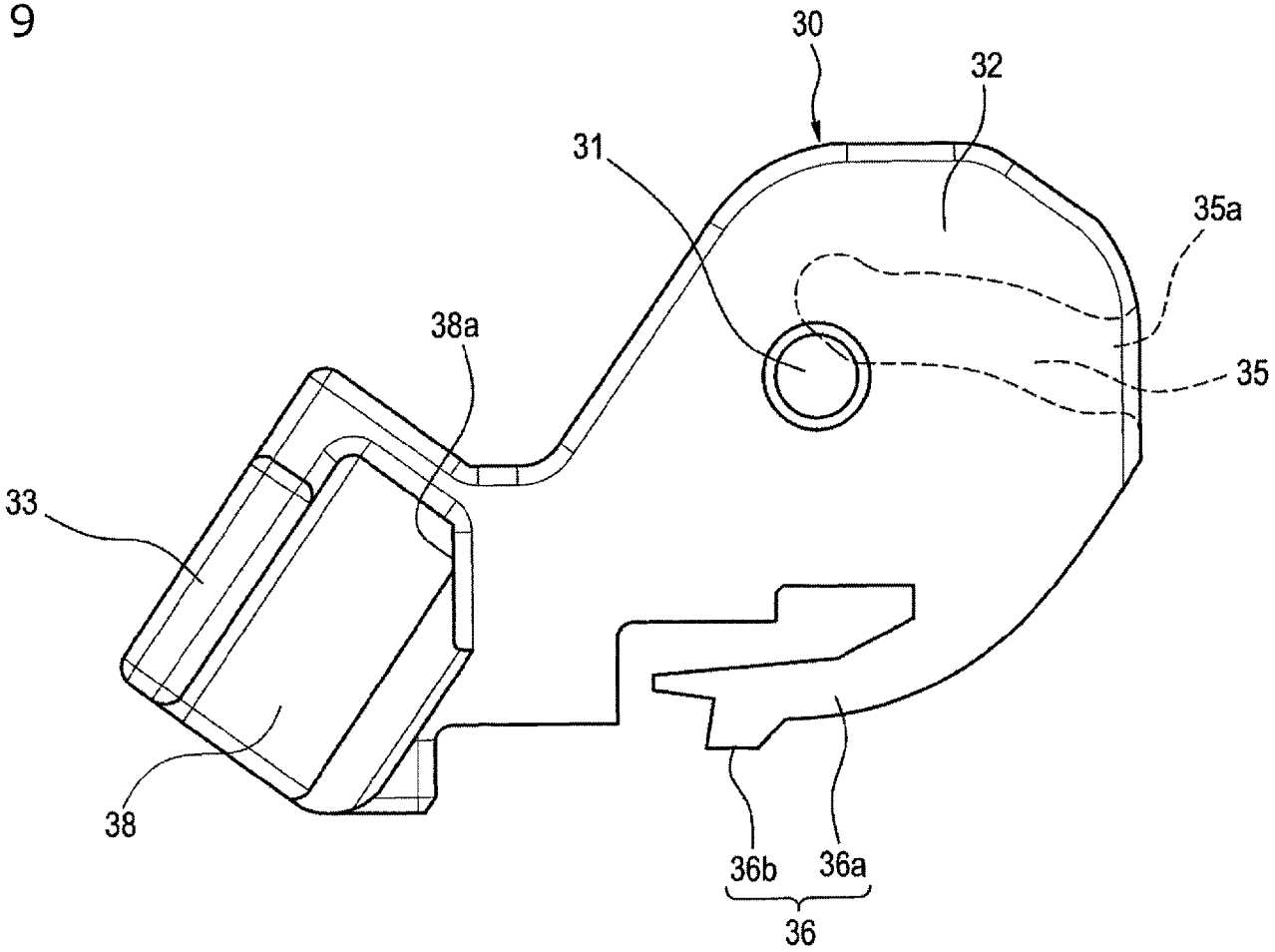
FIG. 9 is a diagram obtained by viewing FIG. 8 from a direction shown by an arrow mark C.

As shown in FIG. 8 and FIG. 9, the fitting operation lever 30 includes a lever main body 32 having a pivot 31 rotatably fitted to the lever support hole 16 of the upper wall 13*a*, and the operation part 33 extended in one end of the lever main body 32.

The lever main body 32 has a thick plate form accommodated in the lever accommodation space 15 of the first connector housing 10 and the pivot 31 protruding in a central part of a side surface. The lever main body 32 is supported in the lever accommodation space 15 so as to be rotatable on the pivot 31 fitted to the lever support hole 16 as a supporting point of rotation.

As shown in FIG. 3, the fitting operation lever 30 is provided so as to be rotatable on the pivot 31 as a center of rotation within a range of an angle θ from the initial rotation position P1 to a rotation finish position P2. The operation part 33 of the fitting operation lever 30 is a part gripped when the fitting operation lever 30 is operated to rotate and provided so as to extend outside from the lever accommodation space 15. The arrow mark R2 illustrated in FIG. 11 shows a rotating direction when the fitting operation lever 30 is rotated from the initial rotation position P1 to the rotation finish position P2.

The lever main body 32 of the fitting operation lever 30 is provided with, as shown in FIG. 8 and FIG. 9, the cam groove 35 in which the fitting protrusion 23 of the second connector housing 20 can slide and the elastic engagement piece 36 which allows the fitting operation lever 30 to be temporarily locked in the initial rotation position P1.

Figure 10:
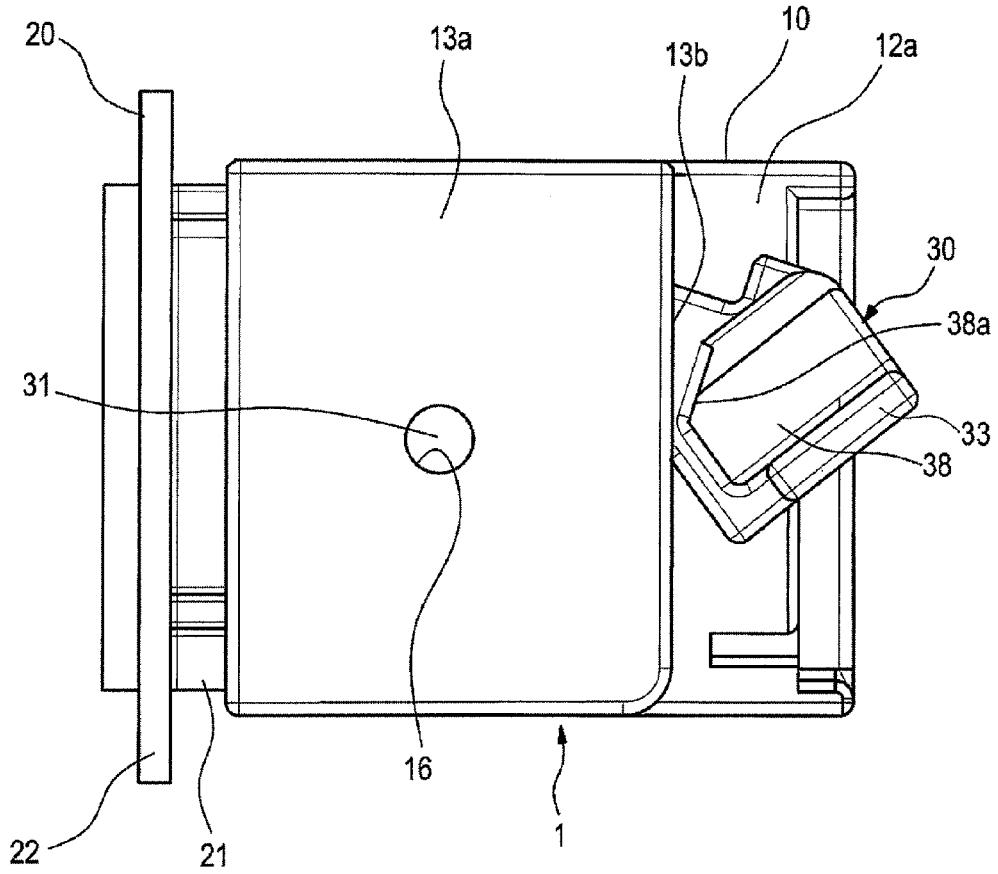
FIG. 10 is a plan view showing a state that the first connector housing and a second connector housing shown in FIG. 1 are butted on each other in a fitting start position.

The cam groove 35 is formed in such a way that when the first connector housing 10 is butted on the second connector housing 20 in a fitting start position under a state that the fitting operation lever 30 is located in the initial rotation position P1 as shown in FIG. 10 and FIG. 11, the fitting protrusion 23 on the second connector housing 20 enters a start end 35*a* (see FIG. 9) of the groove. Further, when the fitting operation lever 30 is operated to rotate from the initial rotation position P1 to a side of the rotation finish position P2, the cam groove 35 allows the fitting protrusion 23 engaged with the start end 35*a* of the groove to be drawn in the mutual fitting direction of the connector housings. Then, the cam groove 35 of the present embodiment allows the first connector housing 10 and the second connector housing 20 to be completely fitted to each other when the fitting operation lever 30 reaches the rotation finish position P2.

As shown in FIG. 9, the elastic engagement piece 36 has a structure including an engaging protrusion 36*b* provided in a tip end of an elastic piece 36*a* extended along an outer periphery of the lever main body 32. The protrusion 36*b* can be displaced to the central side of rotation of the lever main body 32 by a flexible deformation of the elastic piece 36*a*. As shown in FIG. 3, the elastic engagement piece 36 allows the protrusion 36*b* in the tip end to be engaged with the abutting surface as the temporary lever lock mechanism 40 provided in the lever accommodation space 15 of the first connector housing 10 to position the fitting operation lever 30 in the initial rotation position P1.

As shown in FIG. 3, the fitting operation lever 30 is provided with a mark 38*a* by which a state that the temporary locked state of the fitting operation lever 30 is released can be discriminated by visually watching an external appearance. In the present embodiment, the mark 38*a* is one linear side as an edge of a recessed part 38 formed on the surface of the operation part 33 of the fitting operation lever 30.

When the fitting operation lever 30 is temporarily locked by the temporary lever lock mechanism 40, the mark 38*a* of the present embodiment is hidden in an inner side of one side edge (a rear end edge) 13*b* of the upper wall 13*a* as shown in FIG. 2. Further, when the temporary locked state of the fitting operation lever 30 is released by the temporary lock release mechanism 50, the mark 38*a* is exposed outside the one side edge 13*b* of the upper wall 13*a* as shown in FIG. 10 by a minute rotation of the fitting operation lever 30 due to an urging force when the temporary lock release mechanism 50 releases the temporary locked state.

In the lever-type connector 1 of the above-described embodiment, when the fitting operation lever 30 is temporarily locked in the initial rotation position P1 by the temporary lever lock mechanism 40 of the first connector housing 10, the mark 38*a* provided on the fitting operation lever 30 is hidden in the inner side of the upper wall 13*a* of the first connector housing 10 as shown in FIG. 2, so that the mark 38*a* cannot be visually recognized from an external part. However, when the first connector housing 10 is butted on the second connector housing 20 in the fitting start position and the temporary locked state of the fitting operation lever 30 is released by the temporary lock release mechanism 50 of the second connector housing 20, the mark 38*a* on the fitting operation lever 30 is exposed outside the one side edge 13*b* of the upper wall 13*a* of the first connector housing 10 by the minute rotation of the fitting operation lever 30 due to the urging force when the temporary lock release mechanism 50 releases the temporary locked state. Accordingly, by visually recognizing whether or not the mark 38*a* is exposed outside the first connector housing 10, whether or not the temporary locked state of the fitting operation lever 30 is released can be simply discriminated.

Accordingly, an operational error that the fitting operation lever 30 whose temporary locked state is not released is forcedly rotated can be avoided and the fitting operation lever 30 or the temporary lever lock mechanism 40 can be prevented from being broken by the operational error.

Further, in the lever-type connector 1 of the present embodiment, the mark 38*a* of the fitting operation lever 30 is the one linear side forming the edge of the recessed part 38 formed on the surface of the fitting operation lever 30. Accordingly, when the fitting operation lever 30 is formed by, for instance, an injection molding of a resin, the recessed part 38 is formed in a prescribed position so that the mark 38*a* may be simply applied thereto. Thus, the mark 38*a* can be easily provided.

The present invention is not limited to the above-described embodiment, and it is to be understood that the present invention can be suitably changed, modified or improved. In addition thereto, materials, configurations, dimensions, numbers, arranged positions or the like of components elements respectively in the above-described embodiment may be arbitrarily selected and are not limited as long as they can achieve the present invention.

For instance, the mark which makes it possible to discriminate that the temporary locked state is released is not limited to the edge of the recessed part, and a protrusion or a scale by printing can be used.

This application is based on Japanese Patent Application (JPA. No. 2013-192168) filed on Sep. 17, 2013 and its contents are incorporated herein as a reference.

Here, features of the above-described embodiment of the lever-type connector according to the present invention are respectively briefly summarized and listed in below-described [1] to [2].

[1] A lever-type connector (1) including:

a first connector housing (10) that has a lever accommodation space (15) being defined in an inner side of one outer side wall (13*a*) and passing through in a mutual fitting direction of connector housings, a second connector housing (20) that has a fitting part (21) fitted to an inner side of the first connector housing (10) and a fitting protrusion (23) protruding on an outer side surface (21*a*) of the fitting part (21) opposed to the one outer side wall (13*a*), a fitting operation lever (30) provided in the lever accommodation space (15) so as to be rotatable from an initial rotation position (P1) to a rotation finish position (P2), a temporary lever lock mechanism (40) that is provided in the lever accommodation space (15) to temporarily lock the fitting operation lever (30) in the initial rotation position (P1), and a temporary lock release mechanism (50) that is provided in the second connector housing (20) to release the temporary locked state by the temporary lever lock mechanism (40) when the first connector housing (10) is butted on the second connector housing (20) in a fitting start position, wherein the fitting operation lever (30) is provided with a cam groove (35) that allows the fitting protrusion (23) to enter a start end (35*a*) of the cam groove when the first connector housing (10) is butted on the second connector housing (20) in the fitting start position under a state that the fitting operation lever (30) is located in the initial rotation position (P1), allows the fitting protrusion (23) to be drawn in a fitting direction when the fitting operation lever (30) is operated to rotate from the initial rotation position (P1) to a side of the rotation finish position (P2), and allows the first connector housing (10) and the second connector housing (20) to be completely fitted to each other when the fitting operation lever (30) reaches the rotation finish position (P2), and the fitting operation lever (30) is provided with a mark (38*a*) that is covered in an inner side of one side edge (13*b*) of the one outer side wall (13*a*) when the fitting operation lever (30) is located in the temporary locked state by the temporary lever lock mechanism (40), and is exposed outside the one side edge (13*b*) of the one outer side wall (13*a*) by a minute rotation of the fitting operation lever (30) due to an urging force of the temporary lock release mechanism (50) to release the temporary locked state when the temporary locked state is released by the temporary lock release mechanism (50).

[2] The lever-type connector (1) according to the above-described [1], wherein the mark (38*a*) is one linear side forming an edge of a recessed part (38) formed on a surface of the fitting operation lever (30).

INDUSTRIAL APPLICABILITY

In the lever-type connector according to the present invention, a lever-type connector can be provided in which whether or not a temporary locked state of a fitting operation lever is released can be simply discriminated and the fitting operation lever whose temporary locked state is not released can be prevented from being forcedly rotated.

REFERENCE SIGNS LIST

1 . . . lever-type connector 10 . . . first connector housing 13*a* . . . upper wall (one outer side wall) 13*b* . . . one side edge 15 . . . lever accommodation space 20 . . . second connector housing 21 . . . fitting part (hood part) 21*a* . . . upper wall surface (outer side surface) 23 . . . fitting protrusion 30 . . . fitting operation lever 35 . . . cam groove 35*a* . . . start end of groove 38 . . . recessed part 38*a* . . . mark 40 . . . temporary lever lock mechanism 50 . . . temporary lock release mechanism P1 . . . initial rotation position P2 . . . rotation finish position

The invention claimed is:

1. A lever-type connector comprising:

a first connector housing that has a lever accommodation space being defined in an inner side of one outer side wall and passing through in a mutual fitting direction of connector housings;

a second connector housing that has a fitting part fitted to an inner side of the first connector housing and a fitting protrusion protruding on an outer side surface of the fitting part opposed to the one outer side wall;

a fitting operation lever provided in the lever accommodation space so as to be rotatable from an initial rotation position to a rotation finish position;

a temporary lever lock mechanism that is provided in the lever accommodation space to temporarily lock the fitting operation lever in the initial rotation position; and a temporary lock release mechanism that is provided in the second connector housing to release the temporary locked state by the temporary lever lock mechanism when the first connector housing is butted on the second connector housing in a fitting start position, wherein the fitting operation lever is provided with a cam groove that allows the fitting protrusion to enter a start end of the cam groove when the first connector housing is butted on the second connector housing in the fitting start position under a state that the fitting operation lever is located in the initial rotation position, allows the fitting protrusion to be drawn in a fitting direction when the fitting operation lever is operated to rotate from the initial rotation position to a side of the rotation finish position, and allows the first connector housing and the second connector housing to be completely fitted to each other when the fitting operation lever reaches the rotation finish position, the fitting operation lever is provided with a mark that is covered in an inner side of one side edge of the one outer side wall when the fitting operation lever is located in the temporary locked state by the temporary lever lock mechanism, and is exposed outside the one side edge of the one outer side wall by a minute rotation of the fitting operation lever due to an urging force of the temporary lock release mechanism to release the temporary locked state when the temporary locked state is released by the temporary lock release mechanism, the fitting operation lever further includes an elastic engaging piece that engages the temporary lever lock mechanism during the temporary locked state, and the elastic engaging piece is engaged by the temporary lock release mechanism when the first connector housing is butted on the second connector housing in a fitting start position such that the elastic engaging piece disengages from the temporary lever lock mechanism, and the mark is spaced way from the elastic engaging piece such that movement of the mark is prevented until after the elastic engaging piece disengages from the temporary lever lock mechanism.

2. The lever-type connector according to claim 1, wherein the mark is one linear side forming an edge of a recessed part formed on a surface of the fitting operation lever.

3. The lever-type connector according to claim 1, wherein the fitting operation lever further includes an operation part located at a first end of the fitting operation lever, the elastic engaging piece is located on a portion of the fitting operation lever that is between a start end of the cam groove and the operation part, and the start end of the cam groove is located at a second end of the fitting operation lever that is opposite to the first end.

4. A lever-type connector comprising:

a first connector housing that has a lever accommodation space being defined in an inner side of one outer side wall and passing through in a mutual fitting direction of connector housings;

a second connector housing that has a fitting part fitted to an inner side of the first connector housing and a fitting protrusion protruding on an outer side surface of the fitting part opposed to the one outer side wall;

a fitting operation lever provided in the lever accommodation space so as to be rotatable from an initial rotation position to a rotation finish position;

a temporary lever lock mechanism that is provided in the lever accommodation space to temporarily lock the fitting operation lever in the initial rotation position; and a temporary lock release mechanism that is provided in the second connector housing to release the temporary locked state by the temporary lever lock mechanism when the first connector housing is butted on the second connector housing in a fitting start position, wherein the fitting operation lever is provided with a cam groove that allows the fitting protrusion to enter a start end of the cam groove when the first connector housing is butted on the second connector housing in the fitting start position under a state that the fitting operation lever is located in the initial rotation position, allows the fitting protrusion to be drawn in a fitting direction when the fitting operation lever is operated to rotate from the initial rotation position to a side of the rotation finish position, and allows the first connector housing and the second connector housing to be completely fitted to each other when the fitting operation lever reaches the rotation finish position, the fitting operation lever is provided with a mark that is covered in an inner side of one side edge of the one outer side wall when the fitting operation lever is located in the temporary locked state by the temporary lever lock mechanism, and is exposed outside the one side edge of the one outer side wall by a minute rotation of the fitting operation lever due to an urging force of the temporary lock release mechanism to release the temporary locked state when the temporary locked state is released by the temporary lock release mechanism, the fitting operation lever further includes a lever main body, a pivot extending from the lever main body, and an operation part extending from the main body to a first end of the fitting operation lever, the operation part is configured for engagement by an operator in order to rotate the fitting operation lever about the pivot and to the rotation finish position, and the mark is immovable relative to each of the lever main body and the operation part.

5. A lever-type connector comprising:

a first connector housing that has a lever accommodation space being defined in an inner side of one outer side wall and passing through in a mutual fitting direction of connector housings;

a second connector housing that has a fitting part fitted to an inner side of the first connector housing and a fitting protrusion protruding on an outer side surface of the fitting part opposed to the one outer side wall;

a fitting operation lever provided in the lever accommodation space so as to be rotatable from an initial rotation position to a rotation finish position;

a temporary lever lock mechanism that is provided in the lever accommodation space to temporarily lock the fitting operation lever in the initial rotation position; and a temporary lock release mechanism that is provided in the second connector housing to release the temporary locked state by the temporary lever lock mechanism when the first connector housing is butted on the second connector housing in a fitting start position, wherein the fitting operation lever is provided with a cam groove that allows the fitting protrusion to enter a start end of the cam groove when the first connector housing is butted on the second connector housing in the fitting start position under a state that the fitting operation lever is located in the initial rotation position, allows the fitting protrusion to be drawn in a fitting direction when the fitting operation lever is operated to rotate from the initial rotation position to a side of the rotation finish position, and allows the first connector housing and the second connector housing to be completely fitted to each other when the fitting operation lever reaches the rotation finish position, the fitting operation lever is provided with a mark that is covered in an inner side of one side edge of the one outer side wall when the fitting operation lever is located in the temporary locked state by the temporary lever lock mechanism, and is exposed outside the one side edge of the one outer side wall by a minute rotation of the fitting operation lever due to an urging force of the temporary lock release mechanism to release the temporary locked state when the temporary locked state is released by the temporary lock release mechanism, and the mark extends in a direction that is substantially parallel to the one side edge when the fitting operation lever is located in the temporary locked state by the temporary lever lock mechanism, and the mark extends at an acute angle with respect to the one side edge when the temporary locked state is released by the temporary lock release mechanism.

* * * * *